US007750577B2

(12) United States Patent
Nerone et al.

(10) Patent No.: US 7,750,577 B2
(45) Date of Patent: Jul. 6, 2010

(54) APPARATUS AND METHOD FOR PROVIDING AN ISOLATED SET POINT FROM AN INPUT SIGNAL APPLIED TO A LAMP BALLAST

(75) Inventors: Louis R. Nerone, Brecksville, OH (US); Laszlo S. Ilyes, Richmond Heights, OH (US)

(73) Assignee: General Electric Company, Schenectady, NY (US)

( * ) Notice: Subject to any disclaimer, the term of this patent is extended or adjusted under 35 U.S.C. 154(b) by 117 days.

(21) Appl. No.: 12/044,129

(22) Filed: Mar. 7, 2008

(65) Prior Publication Data

US 2009/0224691 A1 Sep. 10, 2009

(51) Int. Cl.
*H05B 37/02* (2006.01)

(52) U.S. Cl. ..... 315/219; 315/276; 315/291

(58) Field of Classification Search ..... 315/209 R, 315/219, 224–225, 272, 276, 287, 291, DIG. 4
See application file for complete search history.

(56) References Cited

U.S. PATENT DOCUMENTS 3,292,007 A * 12/1966 Tiemann ..... 327/445
4,392,087 A * 7/1983 Zansky ..... 315/219
5,422,546 A * 6/1995 Nilssen ..... 315/219
5,604,411 A * 2/1997 Venkitasubrahmanian et al. ..... 315/307
6,072,282 A * 6/2000 Adamson ..... 315/276
6,175,198 B1 1/2001 Nerone
2002/0113556 A1* 8/2002 Tao et al. ..... 315/219
2008/0042588 A1* 2/2008 Chan et al. ..... 315/224

* cited by examiner

*Primary Examiner*—David Hung Vu
*Assistant Examiner*—Tung X Le
(74) *Attorney, Agent, or Firm*—Fay Sharpe LLP

(57) ABSTRACT

The present application discloses a method and apparatus for providing an isolated set point from an input signal. The set point can control the amount of power applied to a lamp via a lamp ballast. An AC output signal from the ballast powers a dimming circuit. The AC signal is coupled across an isolation transformer and subsequently converted into a DC signal. This DC signal is loaded by a variable resistor, which creates a voltage differential across the resistor. This voltage differential is then seen across DC input terminals of the ballast, and it is across the DC input terminals that the set point is created. By varying the value of the resistor, the ballast set point is varied ultimately changing the power that is applied to the lamp by the ballast.

18 Claims, 1 Drawing Sheet

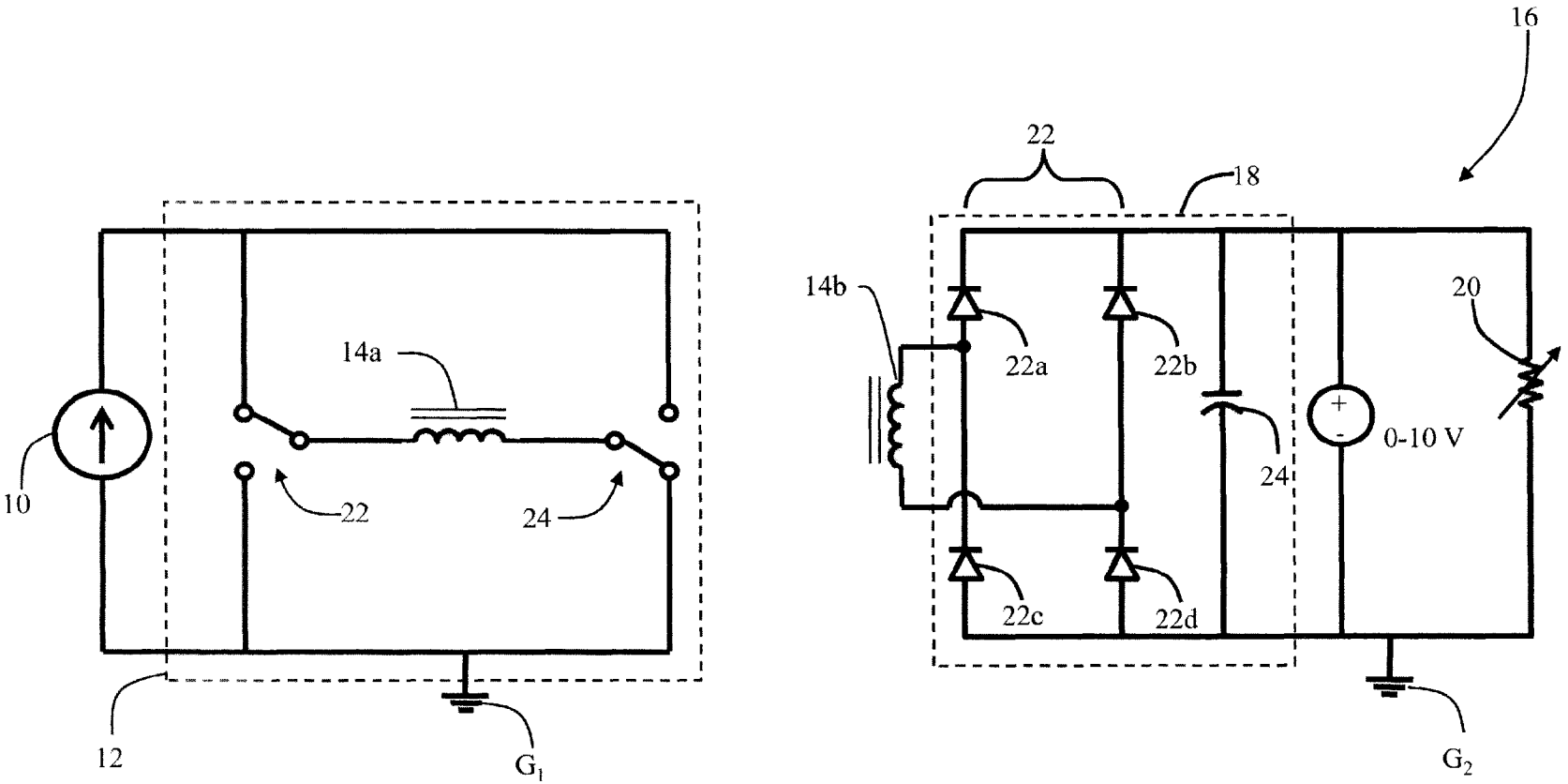
THE FIGURE

APPARATUS AND METHOD FOR PROVIDING AN ISOLATED SET POINT FROM AN INPUT SIGNAL APPLIED TO A LAMP BALLAST

BACKGROUND OF THE INVENTION

The present application relates to the illuminating arts. It finds particular application in providing reliable and accurate dimming of a lamp associated with an inverter ballast and will be described with particular reference thereto. It is to be appreciated that the present dimmer can also provide dimming functionality to other lighting applications and is not limited to the above-referenced application.

In existing frequency dimming ballasts, conventional methods of dimming continuously change the frequency of oscillation to control the amount of current flowing through an arc, and therefore the lumen output of the lamp. This can result in the production of unwanted heat in the lamp drive coil. Additionally, high frequency interfaces can be complex and difficult to implement. Optical interfaces have also been tried with limited success, but are more costly and complex.

In a variable voltage system, the user risks electrical shock unless the interface is electronically isolated from the ballast. In a system that is referenced to a 277 Volt power supply, it would be hazardous to interact with any of the leads unless they were electrically isolated. Previous systems use relatively complicated schemes to monitor a signal across the primary winding of a transformer, pass it through the transformer, then demodulate it. Such a system is complicated and rather non-linear. This type of system also lacks the type of precision desired in a lamp dimmer.

The present application provides a new and improved dimming circuit for an electronic lamp ballast that overcomes the above-referenced problems and others.

BRIEF DESCRIPTION OF THE INVENTION

In accordance with one aspect of the present application, a dimmable lamp powering assembly is provided. The assembly includes a DC voltage source. A ballast inverter converts a DC signal from the DC voltage source into an AC signal for powering a lamp, and the inverter has DC input terminals. A dimming circuit determines a set point voltage at the DC input terminals of the ballast. An isolation transformer isolates the dimming circuit from the ballast inverter.

In accordance with another aspect of the present application, a method of dimming a lamp is provided. A first DC signal is provided to an electronic lamp ballast. The DC signal is converted into an AC signal for powering a lamp. The ballast is isolated from an AC to DC converter with an isolation transformer. The AC signal is converted into a second DC signal with the AC to DC converter. A voltage differential is created by loading the second DC signal. The voltage differential is transposed to DC input terminals of the ballast.

In accordance with another aspect of the present application, a lamp dimming circuit is provided. The circuit includes a DC power source. A lamp ballast having DC input terminals converts a DC input signal into an AC output signal. A dimming circuit determines a set point voltage across the DC input terminals of the ballast. The set point has a nominal value that is much less than a value of the DC power source. The dimming circuit is isolated from the lamp ballast by an isolation transformer. The dimming circuit includes an AC to DC converter. The AC to DC converter includes a full wave bridge rectifier for converting an AC signal to a DC signal. A variable resistor ranges in impedance from 0-20 kΩ for creating a voltage drop in the DC signal. The voltage drop is then transposed to the DC input terminals of the lamp ballast.

BRIEF DESCRIPTION OF THE DRAWINGS

THE FIGURE is a circuit diagram of a ballast dimming circuit, in accordance with the present application.

DETAILED DESCRIPTION OF THE INVENTION

With reference to THE FIGURE, a representation of an external dimmer according to the present application is depicted. A DC current source 10 provides current to a lamp inverter 12 that includes switches 12*a* and 12*b*. The inverter 12 takes the DC input and converts it to AC. The AC signal that the inverter 12 creates is used to power a lamp (not shown). An isolation transformer 14 that includes primary 14*a* and secondary 14*b* windings is used to supply the AC signal to an external dimmer 16. The dimmer includes a rectifier 18 that converts the AC input signal from the isolation transformer 14 into a DC signal. The DC signal from the rectifier 18 is provided to a variable resistor 20. By varying the resistance of the resistor 20, the voltage drop across the resistor 20 also varies. The voltage seen at the isolation transformer also varies in proportion to the voltage drop across the resistor 20. The voltage seen at the isolation transformer 14 is also seen across the inverter 12. This creates a set point for power. For example, if the set point ranges from 0-10 Volts, 10 Volts corresponding to a per-unit value of 1, and 0 Volts corresponding to a per-unit value of 0.5, the ballast ranges from 50-100% power depending on the selected set point voltage. Thus, by varying the voltage across the external dimmer 16, the set point of the inverter 12 is also varied, and the signal that the lamp sees is ultimately affected, having the end result of changing the intensity of the lamp. The current source 10 and the ballast 12 are referenced to a first ground $G_1$. The external dimmer 16 is referenced to a second ground $G_2$, different from the first ground $G_1$, electrically isolating the ballast 12 from the dimmer 16.

The external dimmer 16 can be used with a wide variety of lamp ballasts. One such ballast is described in U.S. Pat. No. 6,175,198 to Nerone, issued Jan. 16, 2001, which is hereby incorporated by reference in its entirety. It is to be understood that the ballast described in the aforementioned patent is exemplary, and other inverter configurations, component values, and the like are equally viable, as one skilled in the art will understand.

With further reference to THE FIGURE, the external dimming circuit 16 controls the intensity of the lamp. As noted earlier, the external dimming circuit 16 is electronically isolated from the ballast 12, that is, the dimming circuit 16 is referenced to ground $G_2$. In the depicted embodiment the dimming circuit 16 includes the secondary winding 14*a* of the isolation transformer 14, the AC/DC converter 18 and the variable resistor 20. The AC/DC converter 18 preferably includes a full wave bridge rectifier 22 that includes rectifying diodes 22*a*, 22*b*, 22*c*, and 22*d*. The diodes 22*a-d* can be typical p-n junction diodes, or for better forward voltage characteristics, they could be Schottky diodes. The rectifier 22 receives the AC input from the inverter 12 and converts it into a DC signal. A smoothing capacitor 24 smoothes the DC signal making it more uniform. Additional smoothing and matching circuitry is also contemplated depending on the desired level of uniformity of the DC signal, tolerable amount of ripple in the signal, and the like. Alternately, the converter 18 can include a half wave rectifier. In another alternative, it could also include a tapped transformer.

The DC signal output is then provided to the variable resistor 20. The resistor 20 loads the DC output. The voltage drop seen across the resistor 20 will be proportional to the input current of the DC signal and the resistance selected. This voltage drop will then be seen across the DC terminals of the inverter 12. In an illustrative example, if the resistor 20 is selected to have a value of 5 kΩ, and the signal output from the rectifier 18 is 1 mA, then the voltage drop across the resistor will be 5 Volts. If the turns ratio of the isolation transformer 14 is 1:1, then a 5 Volt signal will appear at the DC input terminals of the inverter 12. Similarly, if the resistance of the resistor 20 is increased to 10 kΩ, (and the current remains 1 mA) then 10 Volts will appear across the resistor 20 and across the DC input terminals of the ballast inverter 12. In this manner, the voltage at the input terminals of the inverter 12 tracks the voltage established across the external variable resistor 20 in a predictable, linear fashion. The preferred range of the variable resistor 20 is about 0-20 kΩ. Although a 1:2 turns ratio on the isolation transformer 14 is preferred, other ratios are viable possibilities.

The inverter 12 input voltage is then used to generate a set point for a feedback control system. Changes in the external resistor 20 cause the set point to change, thereby changing the power applied to the lamp from the ballast 12. It is preferred that the DC bus is a relatively high voltage, on the order of about 400 to 500 Volts. About 450 Volts is preferred. In this embodiment, with the DC bus voltage from the current source 10 much greater than the set point voltage, the current through the variable resistor 20 has a very low sensitivity to the set point voltage and thus remains nearly constant through the set point range.

The preferred embodiment provides an accurate design for establishing a set point for the purpose of controlling the output power or output current of a ballast. The cost, complexity, and long term stability of this method are an improvement over existing methods. Linearity and precision are also improved.

In an alternate embodiment, the external resistor 20 could be replaced with a variable voltage sink. The voltage sink would also cause a linear change in the inverter input terminals which would likewise vary the set point.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A dimmable lamp powering assembly comprising:

a DC current source;

a ballast inverter for converting a DC signal from the DC current source into an AC signal for powering a lamp, the inverter having DC input terminals;

a dimming circuit for determining a set point voltage at the DC input terminals of the ballast; and an isolation transformer for isolating the dimming circuit from the ballast inverter.

2. The dimmable lamp powering assembly as set forth in claim 1, wherein the dimming circuit includes an AC to DC converter that converts the AC signal of the ballast inverter into a DC signal output.

3. The dimmable lamp powering assembly as set forth in claim 2, wherein the dimming circuit further includes:

a variable resistor that loads the DC signal output from the AC to DC converter.

4. The dimmable lamp powering assembly as set forth in claim 3, wherein the variable resistor selectively provides resistances from 0-20 kΩ to load the DC signal output.

5. The dimmable lamp powering assembly as set forth in claim 2, wherein the dimming circuit further includes:

a variable voltage sink that loads the DC signal output from the AC to DC converter.

6. The dimmable lamp powering assembly as set forth in claim 2, wherein the AC to DC converter includes a full wave bridge rectifier.

7. The dimmable lamp powering assembly as set forth in claim 1, wherein the current source has a nominal value that is substantially greater than the set point voltage to ensure stability of output current.

8. The dimmable lamp powering assembly as set forth in claim 7, wherein the current source has a nominal value between about 400 and 500 Volts.

9. The dimmable lamp powering assembly as set forth in claim 8, wherein the current source has a nominal value of about 450 Volts.

10. A method of dimming a lamp comprising:

providing a first DC signal to an electronic lamp ballast;

converting the DC signal into an AC signal for powering a lamp;

isolating the ballast from an AC to DC converter with an isolation transformer;

converting the AC signal into a second DC signal with the AC to DC converter;

creating a voltage differential by loading the second DC signal; and transposing the voltage differential to DC input terminals of the ballast.

11. The method as set forth in claim 10, wherein the step of creating a voltage differential includes loading the second DC signal with a variable resistor.

12. The method as set forth in claim 11, wherein the variable resistor provides impedances ranging from 0-20 kΩ.

13. The method as set forth in claim 10, wherein the step of creating a voltage differential includes loading the second DC signal with a variable voltage sink.

14. The method as set forth in claim 10, wherein the AC to DC converter includes a full-wave bridge rectifier.

15. The method as set forth in claim 10, wherein the step of providing a first DC signal to the electronic lamp ballast includes providing a first DC signal that has a nominal voltage that is substantially greater than the voltage differential.

16. The method as set forth in claim 15, wherein the first DC signal has a nominal voltage greater than about 400 Volts and less than about 500 Volts.

17. The method as set forth in claim 16, wherein the first DC signal is about 450 Volts.

18. A lamp dimming circuit comprising:

a DC power source;

a lamp ballast having DC input terminals for converting a DC input signal into an AC output signal;

a dimming circuit for determining a set point voltage across the DC input terminals of the ballast where the set point has a nominal value that is much less than a value of the DC power source, the dimming circuit being isolated from the lamp ballast by an isolation transformer, the dimming circuit including:

an AC to DC converter that includes a full wave bridge rectifier for converting an AC signal to a DC signal; and a variable resistor ranging in impedance from 0-20 kΩ for creating a voltage drop in the DC signal, which voltage drop is then transposed to the DC input terminals of the lamp ballast.

* * * * *